United States Patent [19]

Keneman

[11] 4,199,702

[45] Apr. 22, 1980

[54] ELECTRON MULTIPLIER INPUT ELECTRON OPTICS

[75] Inventor: Scott A. Keneman, Trenton, N.J.

[73] Assignee: RCA Corporation, New York, N.Y.

[21] Appl. No.: 682,457

[22] Filed: May 3, 1976

[51] Int. Cl.[2] ..... H01J 43/10; H01J 43/18

[52] U.S. Cl. ..... 313/105 R; 313/400

[58] Field of Search ..... 313/105 R, 104, 400, 313/95, 422; 328/243

[56] References Cited

U.S. PATENT DOCUMENTS

| | | | |
|---|---|---|---|
| 2,175,697 | 10/1939 | Nelson | 313/105 X |
| 2,218,744 | 10/1940 | Colberg | 313/105 X |
| 2,227,018 | 12/1940 | Schlesinger | 313/105 X |
| 3,735,184 | 5/1973 | Maeda | 328/243 |
| 4,029,984 | 6/1977 | Endriz | 313/96 |

FOREIGN PATENT DOCUMENTS

| | | | |
|---|---|---|---|
| 1198046 | 6/1959 | France | 313/104 |

*Primary Examiner*—Robert Segal

*Attorney, Agent, or Firm*—G. H. Bruestle; G. E. Haas; V. J. Coughlin

[57] ABSTRACT

An ion feedback electron multiplier has an envelope containing an ionizable gas. Within the envelope is a chain of multiplier dynodes divided into two planar groups spaced from and parallel to one another. At one end of the multiplier chain is an electron source capable of emitting electrons upon ion bombardment. An electron lens which is between the multiplier chain and the electron source, focuses the electrons from the source onto one of the dynodes of the multiplier.

3 Claims, 2 Drawing Figures

ELECTRON MULTIPLIER INPUT ELECTRON OPTICS

BACKGROUND OF THE INVENTION

This invention relates to ion feedback electron multiplier devices; and particularly to such devices employing input electron optics for the electron multiplier.

Cathodoluminescent display devices, such as for television, have been suggested wherein the electrons are supplied by a multi-dynode electron multiplier operated in a sustained ion feedback mode. These devices have a cathode, as a source of electrons for the multiplier, which emits secondary electrons upon bombardment by ions. If such devices employ a separate electron multiplier for each elememt in a line of the picture, conventional electron multiplier geometry becomes impractical in the physical confines of a display device. The flexibility of positioning the multiplier dynodes with respect to the cathode is severely restricted in such devices.

As a solution to these design restrictions, so called flat multiplier structures have been proposed. These structures employ planar dynodes positioned in two staggered parallel groups. At one end of the multiplier is the cathode which is perpendicular to the planes of the dynode groups. However, this perpendicular structure with planar dynodes, does not provide the high level of electron transmission from the cathode to the first dynode which is necessary for effective operation of the feedback multiplier.

SUMMARY OF THE INVENTION

An ion feedback electron multiplier has an envelope filled with an ionizable gas. Also within the envelope are two groups of dynodes parallel to one another and forming an electron multiplier chain. An electron source which is capable of emitting electrons upon ion bombardment, is within the envelope at one end of the multiplier chain. Between the electron source and the multiplier chain is an electron lens for the focusing the electrons from the source onto one of the dynodes in the chain.

DETAILED DESCRIPTION OF THE INVENTION

Figure 1:
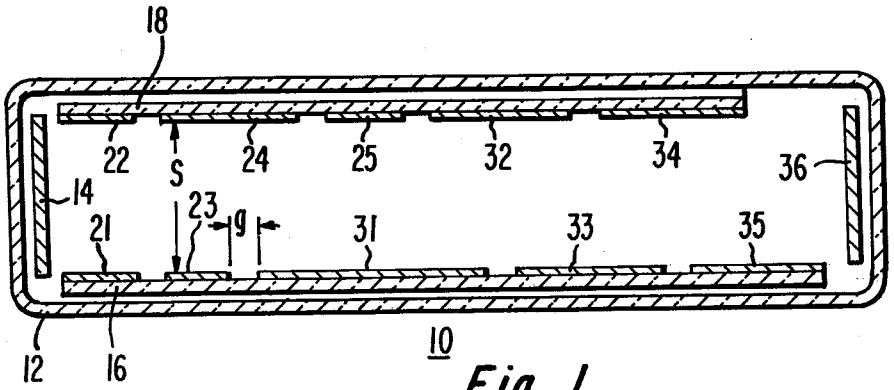
FIG. 1 is a cross-sectional view of an electron multiplier according to the present invention.

With initial reference to FIG. 1, an electron multiplier 10 comprises an envelope 12 containing an ionizable gas. At one end of the interior of the envelope 12 is a cathode 14 having a coating, which will emit electrons efficiently upon ion bombardment, such as MgO. Extending along the length of the envelope 12 are two spaced substantially parallel substrates 16 and 18 of electrical insulating material, such as glass. The substrates are perpendicular to the cathode 14. Five planar input electrodes 21 through 25 are divided into two groups with one of the groups on each of the substrates. Similarly five planar dynodes 31 through 35 are divided into two groups with each group being mounted on a different substrate. The first and third planar electrodes 21 and 23 respectively and the first, third and fifth planar dynodes 31, 33 and 35 are mounted on the first substrate 16 in order from the cathode 14. On the second substrate 18 are the second, fourth, and fifth electrodes and the second and fourth planar dynodes mounted in order from the cathode 14. The five input electrodes 21-25 form an electron lens for focusing the electrons emitted by the cathode 14 onto the first dynode 31. The five dynodes 31-35 form a dynode chain which multiplies electrons. Although the present invention is shown with five electrodes and five dynodes, it is readily apparent that a greater or lesser number of either electrodes or dynodes may be used in practicing the present invention.

In the embodiment shown in FIG. 1, the first and second electrodes 21 and 22 are the same length and are spaced equidistant from the cathode 14. The fourth electrode 24, which is longer than the third electrode 23, extends over a portion of the first dynode 31. The fifth electrode 25 is the same length as the first electrode 21 and is positioned opposite the first dynode 31. The positioning of the electrodes may vary and still accomplish the electron focusing as disclosed herein. The dynodes are positioned on the substrate so that they extend over part of the next dynode in the chain. For example, the first dynode 31 extends over part of the surface of the second dynode 32. Although the planar dynode chain is known in the art, the addition of properly positioned and biased input electrodes achieves the proper focusing of the electrons onto the first dynode 31. This focusing will be described in more detail later.

Although the dimensioning of the electrodes and dynodes in the present invention may differ, the following example is illustrative of the dimensioning of these elements. The spacing, S, between the electrodes on one substrate and the electrodes on the other substrate is 38 mils (about 1 mm). The gap, g, between adjacent electrodes and dynodes on the same substrate is 17.6 mils (about 0.45 mm). The first and second electrodes 21 and 22 are spaced 6.7 mils (about 0.17 mm) from the cathode 14. The fourth electrode 24 is 46.4 mils (about 1.2 mm) wide while the remaining electrodes are 17.6 mils (about 0.45 mm) wide. The first dynode 31 is 75.2 mils (about 2 mm) wide and the other dynodes are 40 mils (about 1 mm) wide.

Adjacent to the opposite end of the substrates 16 and 18 from the cathode 14 is a means 36 for collecting the electrons which have been multiplied. For example, if the device is to be used for image display purposes, the collection means 36 may comprise a cathodoluminescent screen. Electrical leads (not shown) extend through the envelope 12 to the cathode, electrodes, dynodes and collection means so that biasing voltages may be applied to these elements.

During the operation of the device, the cathode 14 is electrically biased with respect to the other elements of the electron multiplier so as to emit electrons. Potentials are applied to the electrodes 21–25 to create an electrical focusing field through which the electrons flow. By applying the proper potentials to the five electrodes, the electrons may be focused onto the first dynode 31. In the device dimensioned above, the cathode 14 is at 0 volts and the first and second electrodes 21 and 22 are maintained at 12 volts. The third electrode 23 is at 45 volts, the fourth electrode 24 is at 80 volts and the fifth electrode 25 is maintained at 0 volts. Potentials are also applied to the dynodes 31 through 35 so that they will attract electrons to their surface and emit secondary electrons upon electron bombardment. The dynodes are so biased so that the electrons will flow from the first dynode to the second dynode and to the third dynode and so on through the multiplier chain. By way of example, the first dynode may be biased at 200 volts with the potential applied to each successive dynode 32–35 increasing in 200 volt increments. Other voltage increments may be used with commensurate change in the input electrode voltages. It is important for efficient electron flow that the voltage difference between the fifth electrode and the first dynode be approximately equal to the inter-dynode voltage difference.

The collection means 36 is biased so that the secondary electrons emitted by the fifth dynode 35 will be attracted to it. Additional electrodes may be between the fifth dynode 35 and the collection means 36 to deflect the electrons onto the collection means.

Figure 2:
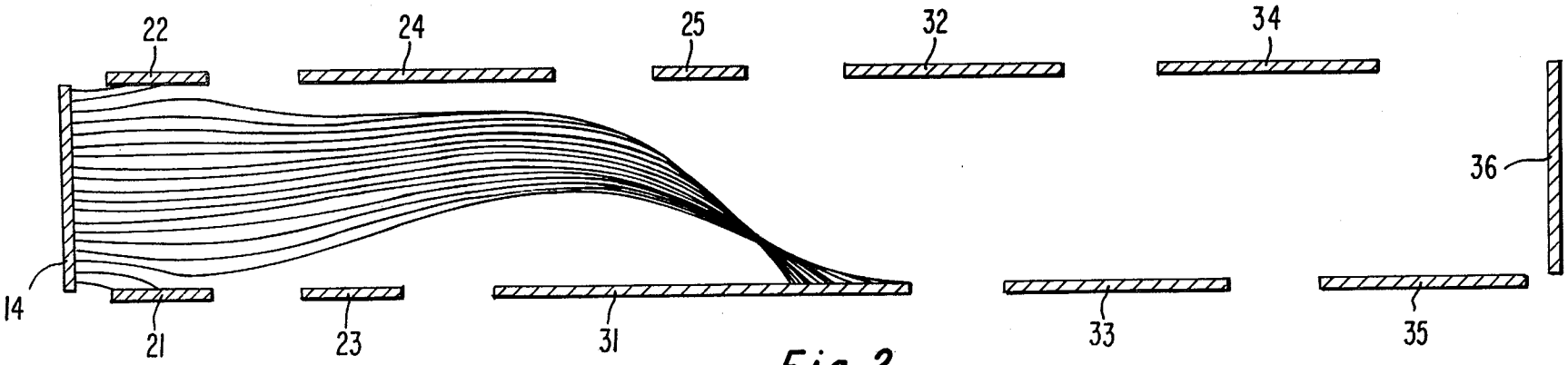
FIG. 2 is a graphical representation of a portion of the electron flow within the electron multiplier of FIG. 1.

FIG. 2 graphically represents the flow of electrons with an energy of 0 eV flowing from the cathode through the electron lens and onto the first dynode 31. The emitted electrons have an initial trajectory which is substantially normal to the surface of the cathode 14. Once these electrons enter the field of the focusing lens, the electrons closer to the third electrode 23 curve toward the fourth electrode 24. As the electrons approach the fifth electrode 25, they are sharply bent toward the first dynode 31 and are focused to a relatively narrow beam width. The electron lens formed by the five electrodes 21–25 directs the electrons from the cathode 14 so that they strike the latter portion of the first dynode 31. Secondary electrons emitted from this portion of the first dynode have the highest probability of reaching the second dynode 32.

When the electrons strike the first dynode, secondary electrons are emitted which travel to the second dynode and so on through the dynode chain. The electrons from the fifth dynode 35 travel to the collection means 36. Some of the electrons from the latter dynodes strike gas molecules in the envelope 12 converting the molecules to positive ions. The ions travel to and strike the cathode 14 emitting additional electrons and completing the feedback loop.

The electron lens formed by the five electrodes 21–25 insures that a high percentage of the electrons emitted from the cathode 14 impinge upon the first dynode 31. The focusing of the electrons emitted by the cathode permits the efficient use of the planar dynode structure with the cathode orthogonal to the dynodes. This multiplier geometry is easily fabricated, especially when used in an array as a display device. Without the focusing optics, a lower percentage of electrons from the cathode would strike the first dynode.

I claim:

1. An ion feedback electron multiplier comprising:

an envelope;

means within the envelope for generating ions;

a chain of dynodes within the envelope, the chain comprising two groups of planar dynodes spaced from and parallel to each other;

an electron source within the envelope at one end of the dynode chain, the source capable of emitting electrons upon ion bombardment; and an electron lens between the dynode chain and the electron source for focusing and bending the path of the electrons from the source to one of the dynodes, the electron lens comprising a plurality of five electrodes divided into two groups, one of the groups being coplanar with one group of dynodes and the other group of electrodes being coplanar with the other group of dynodes, the first and third electrodes being in one group and the second, fourth and fifth electrodes being in the other group.

2. The multiplier as in claim 1 wherein:

the first and second electrodes are of equal length and equidistant from the electron source;

the third electrode being spaced from the first electrode between the first electrode and the first dynode;

the fourth electrode being spaced from the second electrode between the second electrode and the second dynode, the fourth electrode extending over the first dynode; and the fifth electrode being between the fourth electrode and the second dynode and positioned opposite the first dynode.

3. The multiplier as in claim 1 wherein the electron source comprises a cathode orthogonal to the planes of the dynodes.

* * * * *